US010625221B2

(12) United States Patent
Schneider et al.

(10) Patent No.: US 10,625,221 B2
(45) Date of Patent: Apr. 21, 2020

(54) VENTURI DEVICE

(71) Applicants: Evan Schneider, Piedmont, CA (US); Alexander Mitchell, Saint Helena, CA (US)

(72) Inventors: Evan Schneider, Piedmont, CA (US); Alexander Mitchell, Saint Helena, CA (US)

( * ) Notice: Subject to any disclaimer, the term of this patent is extended or adjusted under 35 U.S.C. 154(b) by 124 days.

(21) Appl. No.: 15/674,565

(22) Filed: Aug. 11, 2017

(65) Prior Publication Data

US 2018/0043319 A1 Feb. 15, 2018

Related U.S. Application Data

(60) Provisional application No. 62/373,764, filed on Aug. 11, 2016.

(51) Int. Cl.

| | |
|---|---|
| ***B01F 5/04*** | (2006.01) |
| ***B01F 3/04*** | (2006.01) |
| ***B01F 15/00*** | (2006.01) |
| *F02M 25/08* | (2006.01) |

(52) U.S. Cl.

CPC ..... *B01F 5/0428* (2013.01); *B01F 3/04503* (2013.01); *B01F 3/04787* (2013.01); *B01F 15/00935* (2013.01); *B01F 2003/04872* (2013.01); *B01F 2005/0436* (2013.01); *B01F 2005/0438* (2013.01); *B01F 2215/007* (2013.01); *B01F 2215/0431* (2013.01); *F02M 25/089* (2013.01); *F02M 25/0836* (2013.01)

(58) Field of Classification Search

CPC ..... F02M 25/089; F02M 25/0836; B01F 2005/0438; B01F 3/04503; B01F 3/04787; B01F 5/0428; B01F 2215/007

See application file for complete search history.

(56) References Cited

U.S. PATENT DOCUMENTS 3,799,195 A * 3/1974 Hermans ..... B01F 3/02 137/553

4,123,800 A * 10/1978 Mazzei ..... B01F 5/0415 137/888

(Continued)

*Primary Examiner* — Matthew W Jellett
*Assistant Examiner* — Christopher D Ballman
(74) *Attorney, Agent, or Firm* — AKC Patents, LLC; Aliki K. Collins

(57) ABSTRACT

A Venturi device for introducing a second fluid into a first fluid includes a T-joint, a converging component, and a diverging component. The T-joint component includes a first elongated tube extending along a first direction and a second elongated tube extending along a second direction being perpendicular to the first direction. The converging component is shaped and dimensioned to slip fit within a first through-opening of the first elongated tube through a first inlet port and has a cross-section that decreases along the first direction from the first inlet port to an inner section of the first though-opening. The diverging component is shaped and dimensioned to slip fit within the first through-opening of the first elongated tube through an outlet port and has a cross-section that increases along the first direction from the inner section of the first though-opening to the outlet port. The converging component is coaxially aligned with the diverging component along the first direction.

20 Claims, 10 Drawing Sheets

(56) References Cited

U.S. PATENT DOCUMENTS 4,344,752 A * 8/1982 Gallagher, Jr. ..... B01F 5/0413 137/888
4,416,610 A * 11/1983 Gallagher, Jr. ..... B01F 5/0413 137/888
4,931,225 A * 6/1990 Cheng ..... B01D 19/0005 261/76
5,863,128 A 1/1999 Mazzei
5,935,490 A * 8/1999 Archbold ..... B01F 3/0446 261/76
6,173,526 B1 * 1/2001 Mazzei ..... A01B 79/02 47/48.5
6,623,154 B1 * 9/2003 Garcia ..... B01F 5/0415 137/888
6,631,732 B1 10/2003 Koster et al.
6,767,007 B2 * 7/2004 Luman ..... B01F 3/0446 261/76
7,032,840 B2 * 4/2006 Freidell ..... A01K 13/001 119/665
8,282,817 B1 * 10/2012 Kistner ..... C02F 3/1242 210/150
8,845,178 B2 * 9/2014 Hanada ..... B01F 3/0865 137/888
9,227,161 B2 * 1/2016 Bormes ..... B01F 3/04787
9,295,952 B2 3/2016 Kornfeld et al.
2002/0096792 A1 * 7/2002 Valela ..... B01F 3/0446 261/4
2003/0080037 A1 * 5/2003 Mazzei ..... B01D 19/0068 210/188
2004/0050438 A1 * 3/2004 Haas ..... F04F 5/10 137/888
2010/0014794 A1 * 1/2010 Iida ..... F16C 27/066 384/489
2014/0196795 A1 7/2014 Dunning
2015/0176542 A1 6/2015 Balsdon et al.

* cited by examiner

VENTURI DEVICE

CROSS REFERENCE TO RELATED CO-PENDING APPLICATIONS

This application claims the benefit of U.S. provisional application Ser. No. 62/373,764 filed Aug. 11, 2016 and entitled "VENTURI TUBE DEVICE", the contents of which are expressly incorporated herein by reference.

FIELD OF THE INVENTION

The present invention relates to a Venturi device for entraining fluids and in particular to a Venturi device that can be easily disassembled for cleaning and maintenance.

BACKGROUND OF THE INVENTION

The effect of oxygen in wines is usually considered to be detrimental to their quality, and therefore exposure of wines to oxygen is in general to be avoided. However, there are some cases when the introduction of air or oxygen, (or other gases or liquids) into wine is desirable. One of such cases is during the process of fermentation. Controlled mixing of air or oxygen into the must during fermentation has been found to be beneficial to the fermentation process and the flavor of the wine.

One method of introducing air or oxygen into the must is using a combination of a pump-over mechanism with an in-line Venturi device. One example of a pump-over mechanism is described in U.S. patent application Ser. No. 14/478,269 filed Sep. 5, 2014 and entitled "WINE PUMP-OVER DEVICE", the contents of which are expressly incorporated herein by reference. A Venturi device utilizes the Venturi effect, whereby the pressure of a fluid flowing through a pipe is reduced when the fluid passes through a constricted section of the pipe. The pressure differential between the pipe section before the constricted section and after the constricted section causes a secondary fluid (i.e., air) to be pulled into the pipe and become entrained and mixed with the stream of the fluid.

Most of the currently available Venturi devices used in the wine making industry are made either of stainless steel or polymeric materials such as Polyvinylidene fluoride (PVDF) or Ethylene ChloroTriFluoroEthylene (ECTFE). These materials are used because of their high purity, their resistance to chemicals and because they are inert and corrosion resistant. Polymeric material based Venturi devices are relatively inexpensive, but usually prone to breaks. Steel based Venturi devices are usually expensive, break resistant, and suitable for high strength applications. It is desirable to have an inexpensive Venturi device that is easy to clean, maintain and assemble and is compatible with the wine making and food processing procedures.

SUMMARY OF THE INVENTION

The present invention relates to an inexpensive Venturi device that can be easily disassembled for cleaning and maintenance.

In general, in one aspect, the invention features a Venturi device for introducing a second fluid into a first fluid including a T-joint, a converging component, and a diverging component. The T-joint component includes a first elongated tube extending along a first direction and a second elongated tube extending along a second direction being perpendicular to the first direction. The first elongated tube comprises a first inlet port and an outlet port and a first though-opening extending from the first inlet port to the outlet port along the first direction and the second elongated tube is integral with the first elongated tube and comprises a second inlet port and a second though-opening communicating with the first through-opening and extending along the second direction from the second inlet port to an inner section of the first though-opening. The converging component is shaped and dimensioned to slip fit within the first through-opening of the first elongated tube through the first inlet port and has a cross-section that decreases along the first direction from the first inlet port to the inner section of the first though-opening. The diverging component is shaped and dimensioned to slip fit within the first through-opening of the first elongated tube through the outlet port and has a cross-section that increases along the first direction from the inner section of the first though-opening to the outlet port. The converging component is coaxially aligned with the diverging component along the first direction. The first fluid enters the converging component through the first inlet port and flows toward the inner section of the first though-opening and the second fluid is drawn into the inner section of the first through-opening from the second inlet port through the second through-opening and the second fluid mixes with the first fluid in the inner section of the first through-opening, thereby forming a mixed fluid, and the mixed fluid flows through the diverging component and exits though the outlet port.

Implementations of this aspect of the invention include one or more of the following. A gap is formed between adjacent inner ends of the converging component and the diverging component, and the gap is located within the inner section of the first through-opening, and the second fluid mixes with the first fluid within the gap. The converging component position and the diverging component position within the T-joint component are secured and the gap remains unchanged during operation. First and second shoulders are formed around an outer end of the converging cone and an outer end of the diverging cone, and the first and second shoulders are recessed into the inlet port and outlet port of the T-joint, respectively, thereby securing the converging component position and the diverging component position within the T-joint and relative to each other. The converging component comprises an elongated body having a cylindrical section near an outer end, a converging frusto-conical inner section near an inner end and an axial through-opening extending from the outer end to the inner end along the first direction. The diverging component comprises an elongated body having a cylindrical inner section near an inner end, a diverging frusto-conical inner section near an outer end and an axial through-opening extending from the inner end to an outer end along the first direction. The converging component comprises a converging angle in the range of 5 to 8 degrees relative to the first direction and the diverging component comprises a diverging angle in the range of 15 to 25 degrees relative to the first direction. The device further includes first and second O-rings surrounding the converging component and the diverging component, respectively. The converging component comprises teeth extending from an inner end of the converging component along the first direction and the teeth couple with the inner end of the diverging component. The converging component comprises fins located on an outer surface of the converging frusto-conical section. The diverging component comprises fins located on an outer surface of the diverging frusto-conical section. The device further includes first and second gaskets integral with the outer end of the converging component and the outer end of the diverging component, respectively. The first and second gaskets comprise a triangular cross-section. The T-joint component comprises one of stainless steel, cast steel, non-corrosive metal, ceramic, composite or polymer material. The converging component and the diverging component comprise one of polymer materials, stainless steel, metal alloys, non-corrosive metals, ceramics, or composites. The first fluid comprises one of wine, tea, cider, coffee, probiotic liquid, water, or gasoline. The second fluid comprises one of air, oxygen, gas, food additives, or liquid.

In general, in another aspect, the invention features a method for introducing and mixing a second fluid into a first fluid including the following. Providing a Venturi device comprising a T-joint component, a converging component and a diverging component, wherein the T-joint component comprises a first elongated tube extending along a first direction and a second elongated tube extending along a second direction being perpendicular to the first direction, wherein the first elongated tube comprises a first inlet port and an outlet port and a first though-opening extending from the first inlet port to the outlet port along the first direction and wherein the second elongated tube is integral with the first elongated tube and comprises a second inlet port and a second though-opening communicating with the first through-opening and extending along the second direction from the second inlet port to an inner section of the first though-opening; wherein the converging component is shaped and dimensioned to slip fit within the first through-opening of the first elongated tube through the first inlet port and comprises a cross-section that decreases along the first direction from the first inlet port to the inner section of the first though-opening; wherein the diverging component is shaped and dimensioned to slip fit within the first through-opening of the first elongated tube through the outlet port and comprises a cross-section that increases along the first direction from the inner section of the first though-opening to the outlet port; and wherein the converging component is coaxially aligned with the diverging component along the first direction. Next, introducing the first fluid into the converging component through the first inlet port and flowing the first fluid toward the inner section of the first though-opening. Next, drawing the second fluid into the inner section of the first through-opening from the second inlet port through the second through-opening. Next, mixing the second fluid with the first fluid in the inner section of the first through-opening thereby forming a mixed fluid, and then flowing the mixed fluid through the diverging component and exiting the mixed fluid though the outlet port. The first fluid comprises one of wine, tea, cider, coffee, probiotic liquid, water, or gasoline. The second fluid comprises one of air, oxygen, gas, food additives, or liquid. A gap is formed between adjacent inner ends of the converging component and the diverging component and the gap is located within the inner section of the first through-opening and the second fluid mixes with the first fluid within the gap.

The details of one or more embodiments of the invention are set forth in the accompanying drawings and description below. Other features, objects and advantages of the invention will be apparent from the following description of the preferred embodiments, the drawings and from the claims.

DETAILED DESCRIPTION OF THE INVENTION

The present invention provides a Venturi device that is easy to clean, maintain and assemble and is compatible with the wine making and food processing procedures.

Figure 1:
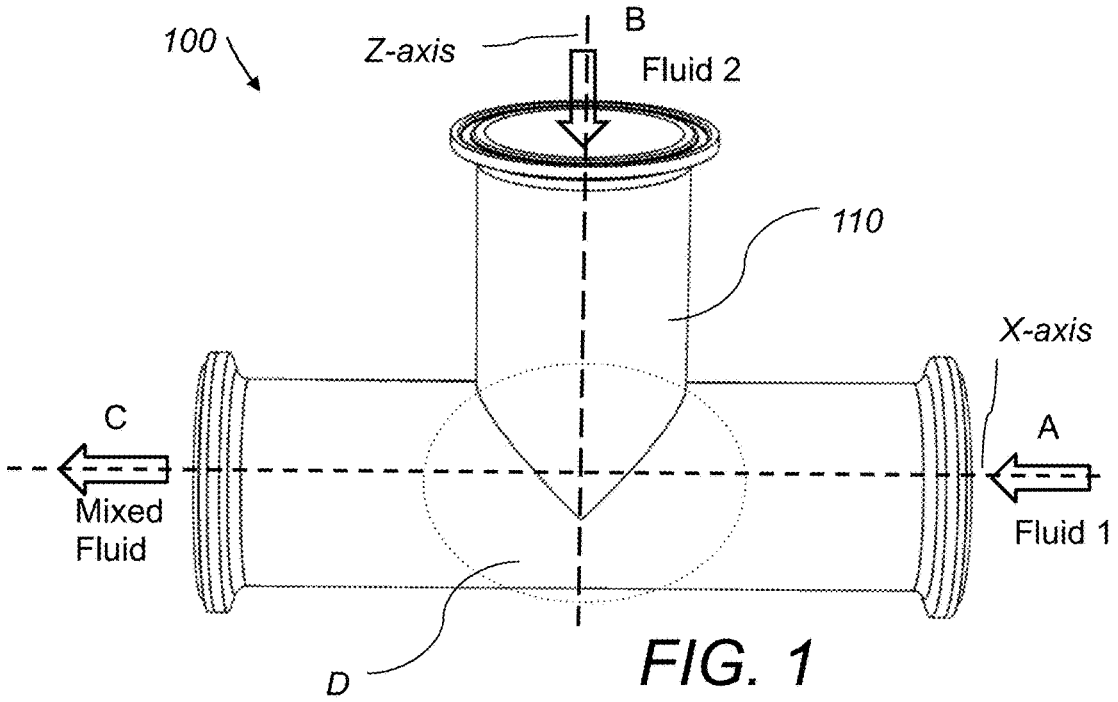
FIG. 1 depicts a Venturi device of this invention.
Figure 2:
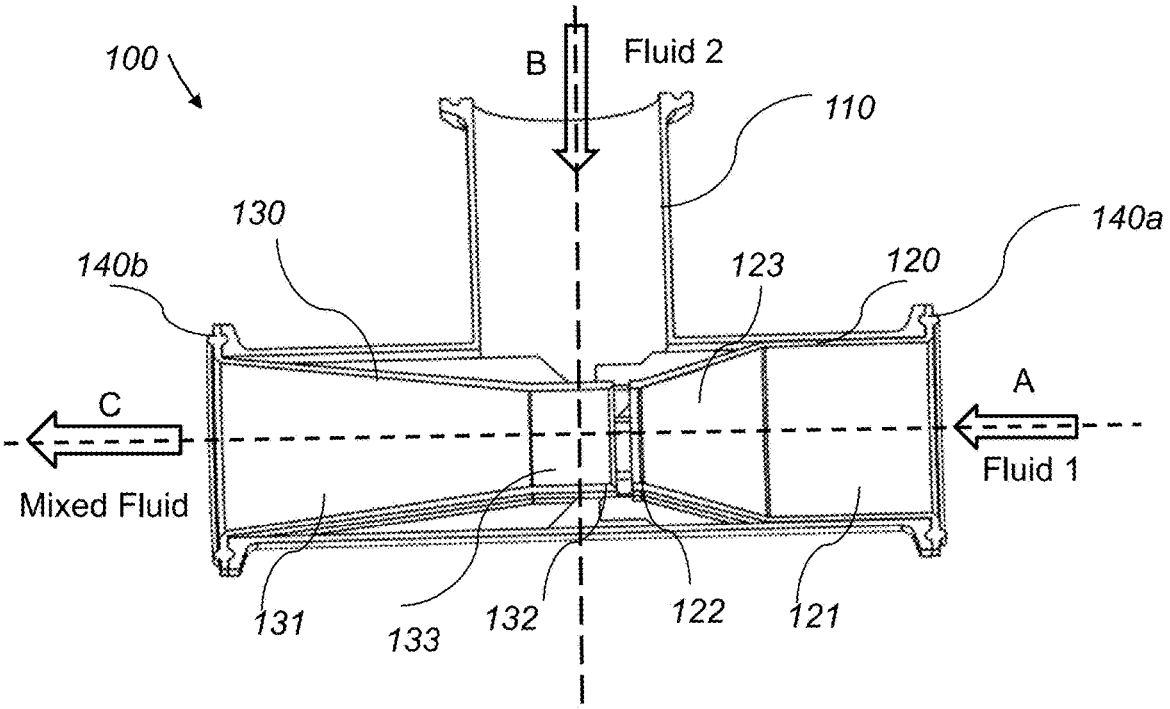
FIG. 2 is cross-sectional view of the Venturi device of FIG. 1.
Figure 7:
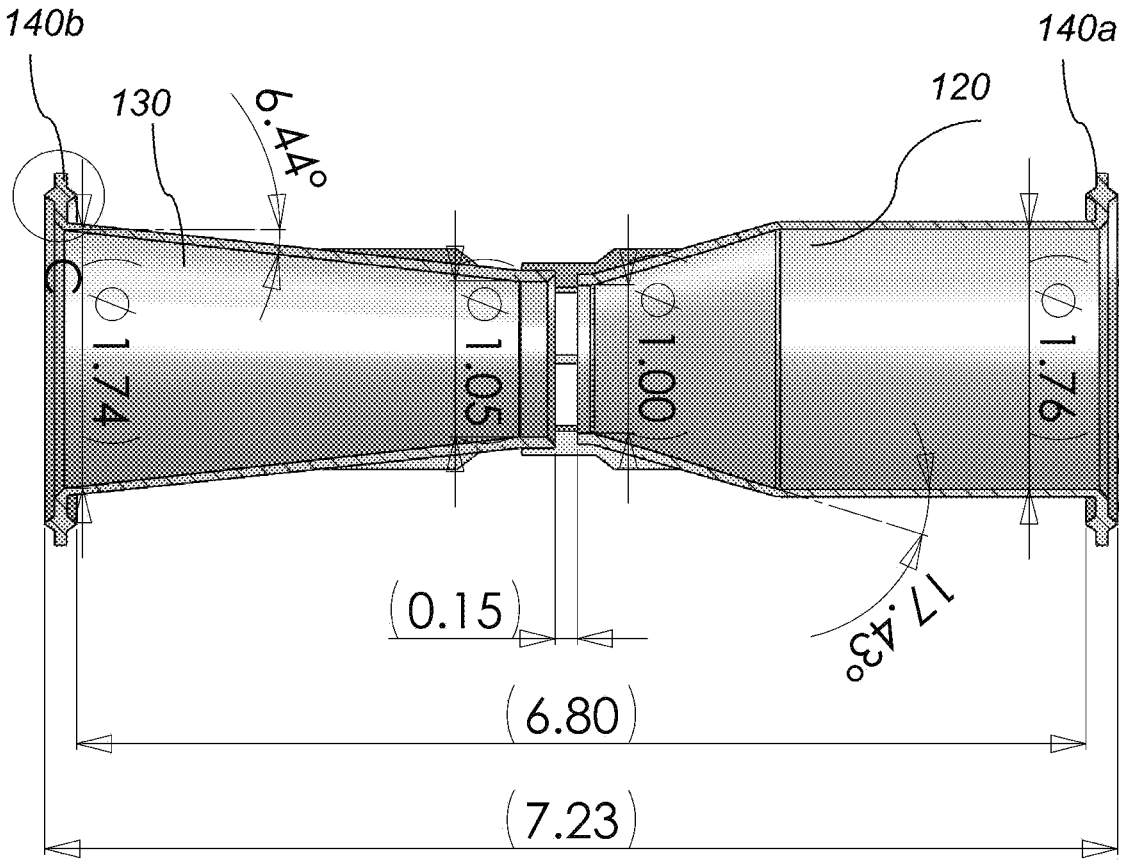
FIG. 7 is a cross-sectional view of the assembled converging and diverging cones 120, 130 of FIG. 2 along the X-Z plane.
Figure 13:
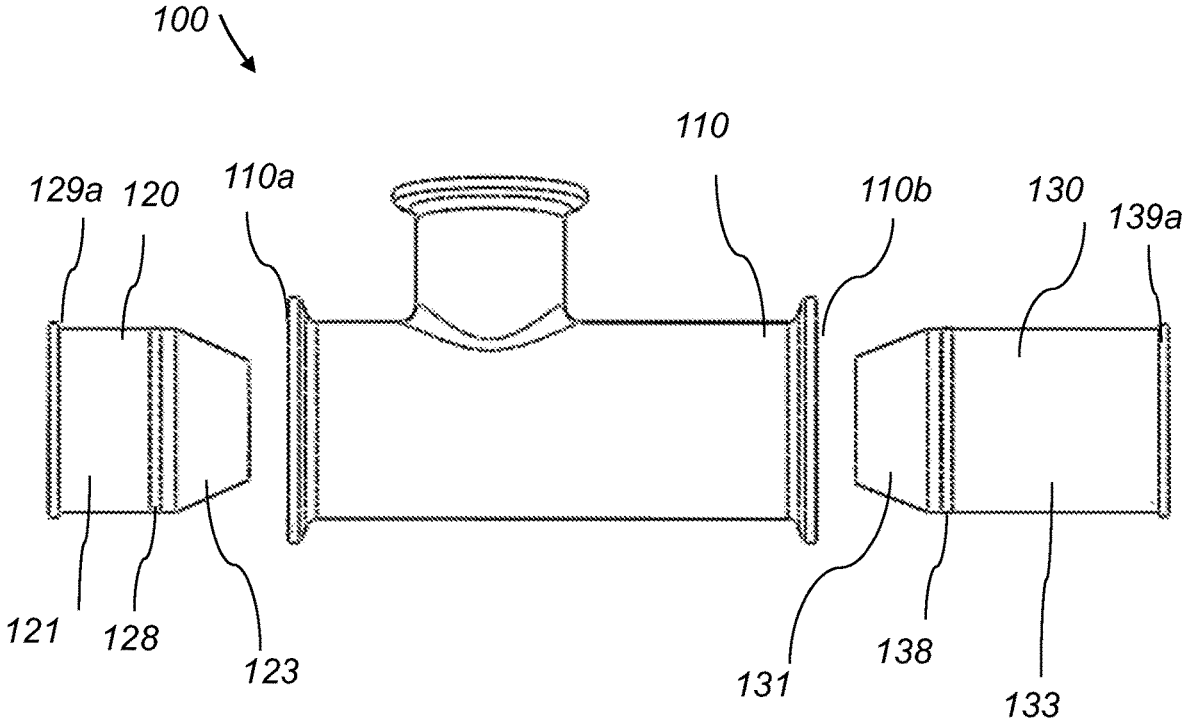
FIG. 13 is an exploded view of the Venturi device of FIG. 11.
Figure 14:
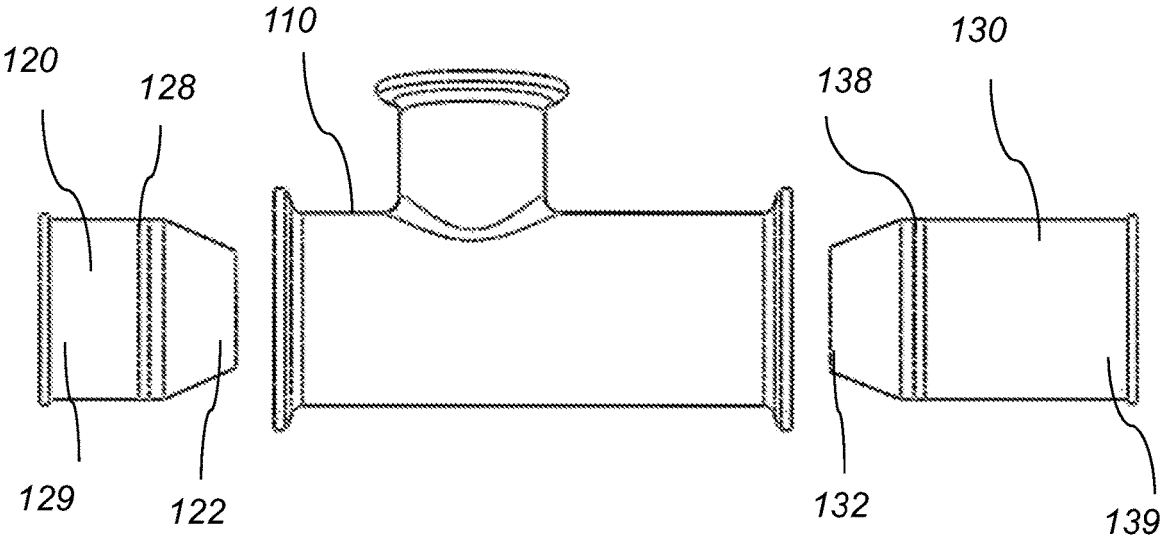
FIG. 14 is an exploded view of another embodiment of the Venturi device of FIG. 11.

Referring to FIG. 1 and FIG. 2, a Venturi device 100 according to this invention includes a T-joint 110, a converging cone 120, a diverging cone 130 and gaskets 140*a* and 140*b* integrated with the ends of the converging cone 120 and the diverging cone 130, respectively. Converging cone 120 and diverging cone 130 are coaxially and concentrically aligned along the X-axis. In one example, converging cone 120 is connected to the diverging cone 130 via a slip-fit. Both the converging and diverging cones 120, 130 are shaped and dimensioned to slide and fit within the T-joint 110. The cross-section of the converging cone 120 decreases along the flow direction along axis X from inlet port A to section D. The cross-section of the diverging cone 130 increases along the flow direction along axis X from section D to outlet port C. In this embodiment, the inlet port B for fluid 2 is positioned in the center between the inlet port A for fluid 1 and the outlet port C for the mixed fluid. The T-joint 110 is made of stainless steel, cast steel, or any other non-corrosive metal or alloy. In other embodiments T-joint 110 is made of ceramic, composite or polymer materials, as shown in FIG. 14. Converging cone 120 and diverging cone 130 are made of injection molded polymeric materials and are designed to have their ends 122 and 132 axially aligned with each other. In other embodiments, the converging and/or diverging cones are made of steel or other metals, alloys, ceramics, or composites, as shown in FIG. 13. The converging cone 120 and the diverging cone 130 are designed to slide, fit and interlock with each other within the T-joint 110. In one example, converging cone 120 and diverging cone 130 are made of rigid plastic materials and gaskets 140*a*, 140*b* are soft gaskets that are integrated and co-molded with the converging cone 120 and diverging cone 130, respectively. In the example of FIG. 7, converging cone 120, diverging cone 130, and gaskets 140*a*, 140*b* are all made of semi-rigid plastic, such as Polypropylene Impact Copolymer Moplen EP332L manufactured by LyondellBasell Industries. The three-component structure of the Venturi device 100 can be easily assembled and disassembled for cleaning and maintenance purposes. The plastic converging cone 120 and diverging cone 130 are inserted into the T-joint 110 from opposite ends 110*a*, 110*b*, respectively, and couple with each other at ends 122 and 132 upon full insertion to ensure axial alignment with each other. Once assembled together, converging cone 120 and diverging cone 130 are not visible from the outside of the Venturi device 100.

Figure 3:
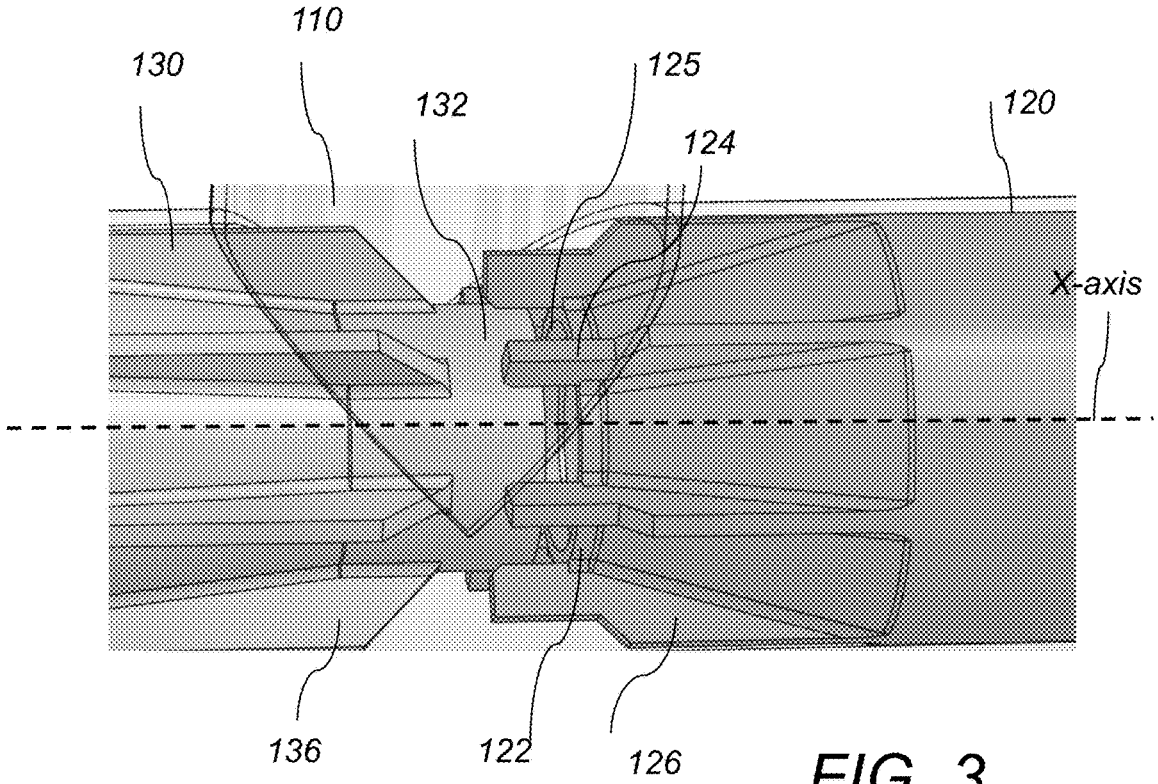
FIG. 3 is an enlarged detailed view of the connection between the converging and diverging cones in section D of the Venturi device of FIG. 2.
Figure 4:
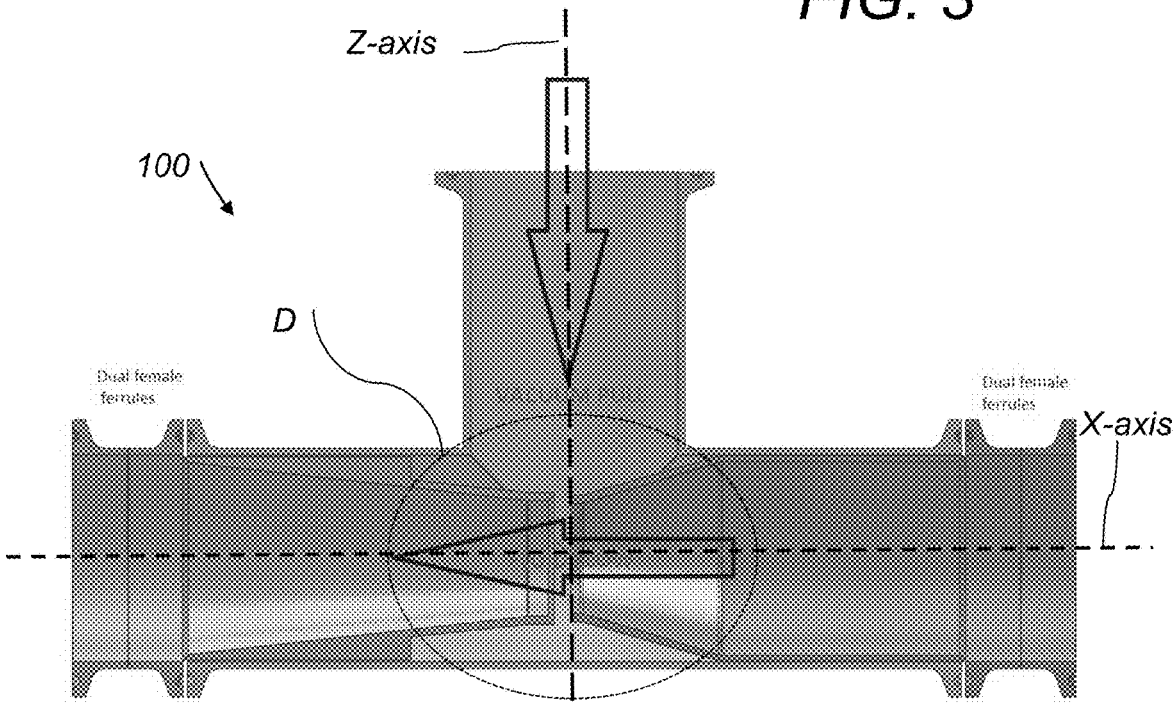
FIG. 4 depicts a cross-sectional view of another embodiment of a Venturi device, according to this invention.
Figure 5:
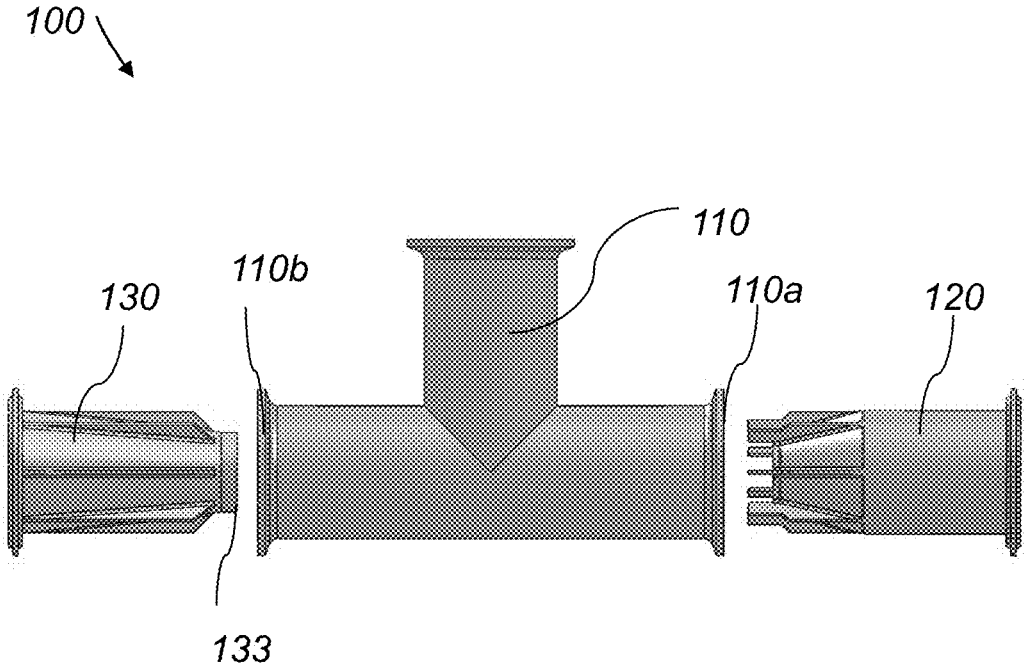
FIG. 5 is an exploded view of the Venturi device of FIG. 2.
Figure 6:
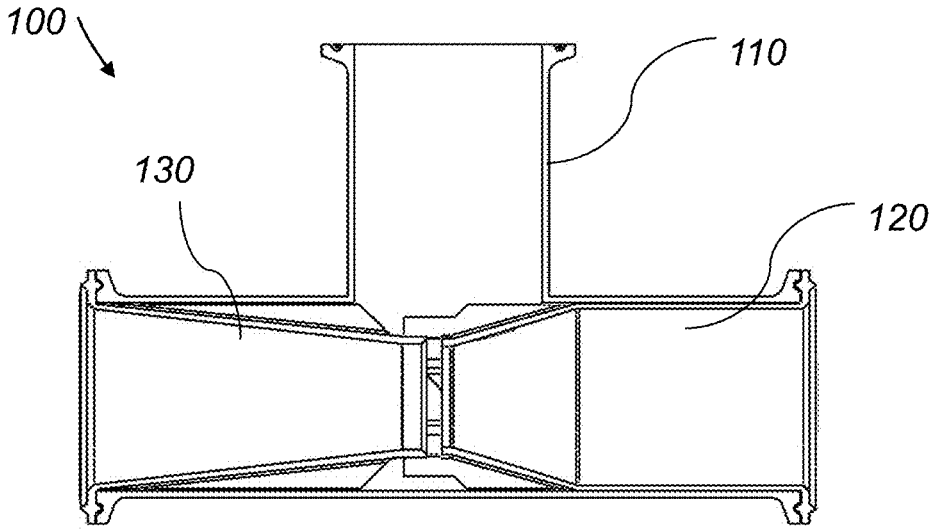
FIG. 6 is a cross-sectional view of the Venturi device of FIG. 2 along the X-Z plane.

Referring to FIG. 2, and FIG. 3, converging cone 120 includes a cylindrical body section 121 and a converging frusto-conical shaped section 123. Frusto-conical shaped section 123 includes teeth 124 extending from end 122 along the horizontal X-axis and fins 126 located on a portion of the outer surface of the conical section 123. Diverging cone 130 includes a diverging frusto-conical shaped section 131 and a cylindrical section 133 terminating at end 132. Fins 136 extend along a portion of the outer surface of the diverging section 131 and a portion of the cylindrical section 133, as shown in FIG. 3. In the embodiment of FIG. 5, diverging cone 130 includes fins 136 that extend along the entire outer surface of the diverging section 131. The teeth 124 of the conical shaped section 123 couple with the end 132 of the cylindrical section 133 of the diverging cone 130 to connect the converging cone 120 with the diverging cone 130 in a coaxial and concentric manner along the X-axis. This concentric and co-axial connection of the two components 120, 130 ensures that the liquid flow is unobstructed.

In operation, a first fluid 1, i.e., wine, enters the Venturi 100 from inlet port A along the X-axis and a second fluid 2, i.e., air and/or oxygen is drawn into the Venturi 100 from port B along the Z-axis and is entrained within the flow of fluid 1. The two fluids 1 and 2 are mixed in section D of the Venturi and the mixed fluid exits from outlet port C along the X-axis. A circular gap 125 is formed between the ends 122 and 132 of the converging cone 120 and the diverging cone 130, respectively. Gap 125 allows fluid 2 to enter the flow stream of fluid 1 and to mix with fluid 1.

Figure 9A:
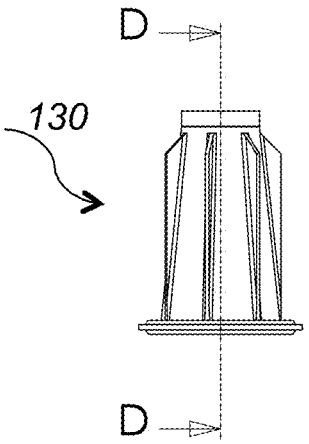
FIG. 9A depicts the diverging cone of the embodiment in FIG. 2.
Figure 9B:
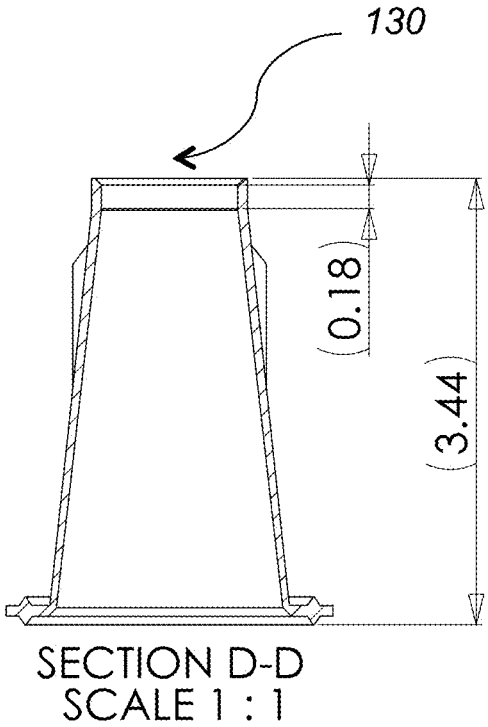
FIG. 9B depicts a cross-sectional view of the diverging cone of the embodiment in FIG. 2.
Figure 10A:
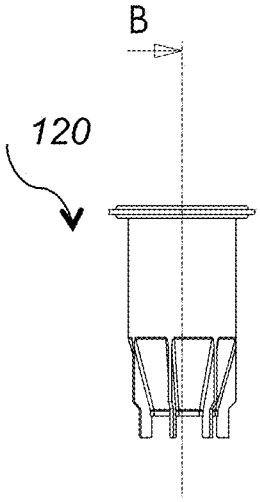
FIG. 10A depicts the converging cone of the embodiment in FIG. 2.
Figure 10B:
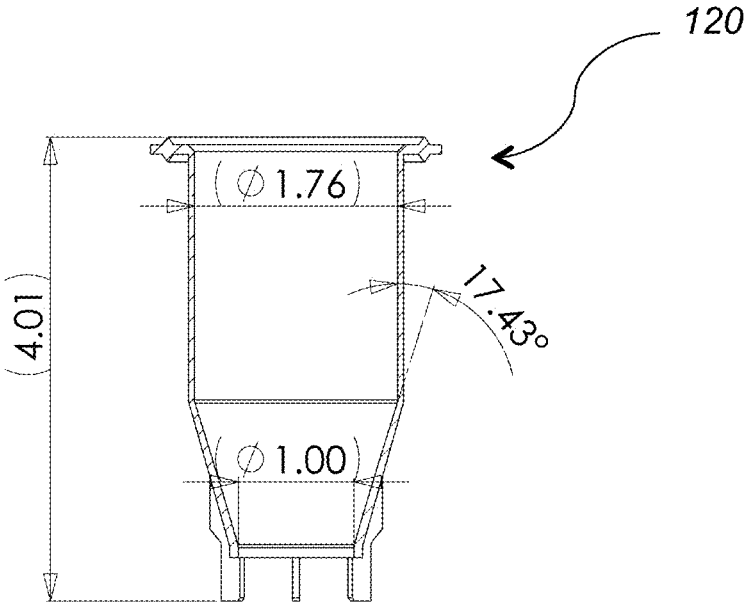
FIG. 10B depicts a cross-sectional view of the converging cone of the embodiment in FIG. 2.
Figure 11:
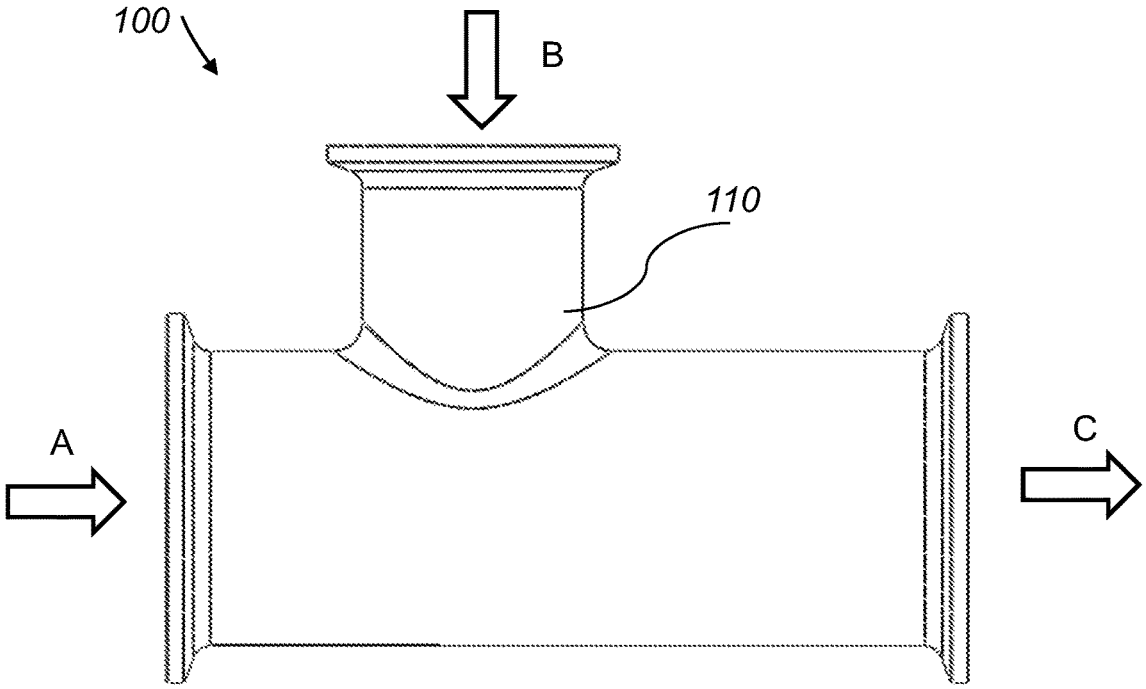
FIG. 11 depicts another embodiment of the Venturi device of this invention.
Figure 12:
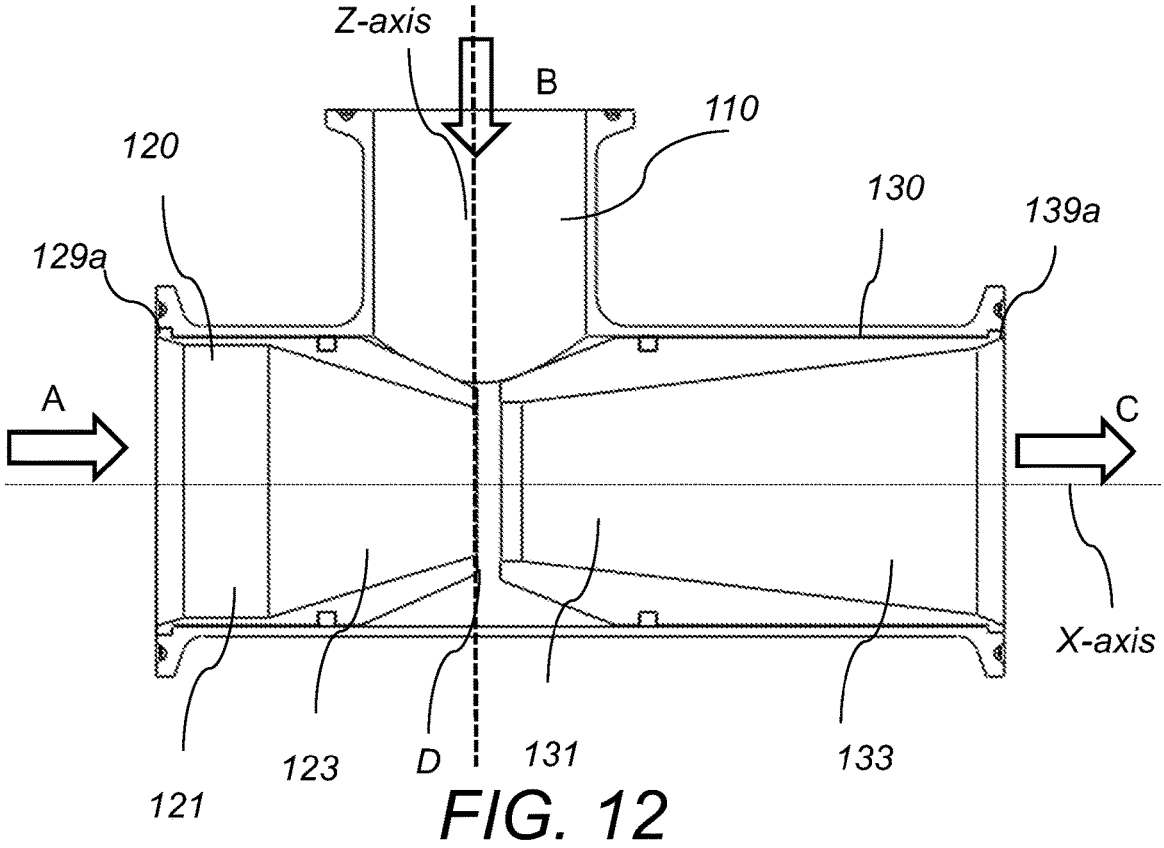
FIG. 12 is cross-sectional view of the Venturi device of FIG. 11.

The dimensions of the converging and diverging cones 120, 130 are optimized to provide a large volume of the second fluid 2 with as low of a pressure drop as possible. In one example, the assembled converging and diverging cones have a total length of 7.23 inches, as shown in FIG. 7. The converging cone 120 has a length of 4.01 inches, an inlet diameter of 1.76 inches, an outlet diameter of 1 inch and a conical angle of 17.43 degrees relative to the X-axis, as shown in FIG. 10B. The corresponding diverging cone 130 has a length of 3.44 inches, an inlet diameter of 1.05 inches, an outlet diameter of 1.74 inches and a conical angle of 6.44 degrees relative to the X-axis, as shown in FIG. 9B. In this example, the gap 125 is 0.15 inch. In other examples, gap 125 is in the range of 0.05 to 0.2 inches. In this example, the cylindrical portion 133 of the diverging cone 130 has a length of 0.18 inches, as shown in FIG. 9B.

Figure 8:
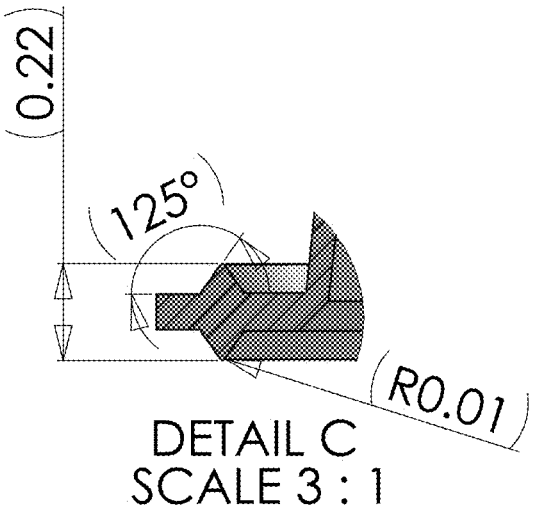
FIG. 8 is an enlarged detailed view of the gasket area C of FIG. 7.

In one embodiment the integrated gaskets 140*a*, 140*b* are made of semi-rigid materials and have triangular cross-sections, as shown in FIG. 7 and FIG. 8. Prior art gaskets are usually shaped to match the semi-circular profile of the TriClamp (T/C) ferrule. However, by using a gasket with a triangular cross-section, stress is concentrated at the tip and a good seal is created even with materials that are stiffer than would normally be ideal for sealing purposes. In some embodiments, the T-joint 110, the converging cone 120, and the diverging cone 130 of the Venturi device 100 are made of stainless steel. The Venturi device 100 may be used for any type of liquid or gas including wine, cider, tea, coffee, probiotic liquids, water, air, and gasoline, among others.

Referring to FIG. 11 to FIG. 15, another embodiment of a Venturi device 100 according to this invention includes a T-joint 110, a converging cone 120, and a diverging cone 130. Converging cone 120 and diverging cone 130 are coaxially and concentrically aligned along the X-axis. Concentricity is achieved by coupling the outlet of the converging cone 120 and the inlet of the diverging cone with the inner diameter of the T-joint 110. Both the converging and diverging cones 120, 130 are shaped and dimensioned to slide and fit within the T-joint 110. The cross-section of the converging cone 120 decreases along the flow direction along axis X from inlet port A to section D. The cross-section of the diverging cone 130 increases along the flow direction along axis X from section D to outlet port C. Converging cone 120 includes a cylindrical body section 121 and a converging frusto-conical shaped section 123. Diverging cone 130 includes a diverging frusto-conical shaped section 131 and a cylindrical section 133 terminating at end 132. In this embodiment, the inlet port B for fluid 2 is positioned closer to the inlet port A for fluid 1 than the outlet port C. The T-joint 110 is made of stainless steel, cast steel, or any other non-corrosive metal or alloy. In other embodiments T-joint 110 is made of ceramic, composite or polymer materials, as shown in FIG. 14. Converging cone 120 and diverging cone 130 are made of injection molded polymeric materials, as shown in FIG. 14, and are designed to have their inner ends 122 and 132 axially aligned with each other. In other examples, converging cone 120 and diverging cone 130 are made of cast urethane or other molded plastic material. In the example of FIG. 13, the T-joint 110 is made of stainless steel and the converging and diverging cones 120, 130 are made of steel or other metals, alloys, ceramics, or composites. The assembled Venturi 100 connects to other tubes with clamps and conventional gaskets. In the example of FIG. 14, converging cone 120 and diverging cone 130 are made of rigid plastic materials and the gaskets are soft gaskets. In another example, converging cone 120, and diverging cone 130 are made of semi-rigid plastic, such as Polypropylene Impact Copolymer Moplen EP332L manufactured by LyondellBasell Industries. The three-component structure of the Venturi device 100 can be easily assembled and disassembled for cleaning and maintenance purposes. The plastic converging cone 120 and diverging cone 130 are inserted into the T-joint 110 from opposite ends 110*a*, 110*b*, respectively. O-rings 128 and 138 around the cylindrical portions 121 and 133 of the converging cone 120 and diverging cone 130, respectively, provide radial seals with the inner walls of the T-joint 110. Small shoulders 129*a*, 139*a* are formed around the outer ends 129 and 139 of the converging cone 120 and diverging cone 130, respectively, and are recessed into the T-joint ends 110*a*, 110*b*, respectively, in order to keep the cones 120, 130 in place within the T-joint 110. Once assembled together, converging cone 120 and diverging cone 130 are not visible from the outside of the Venturi device 100.

Figure 15:
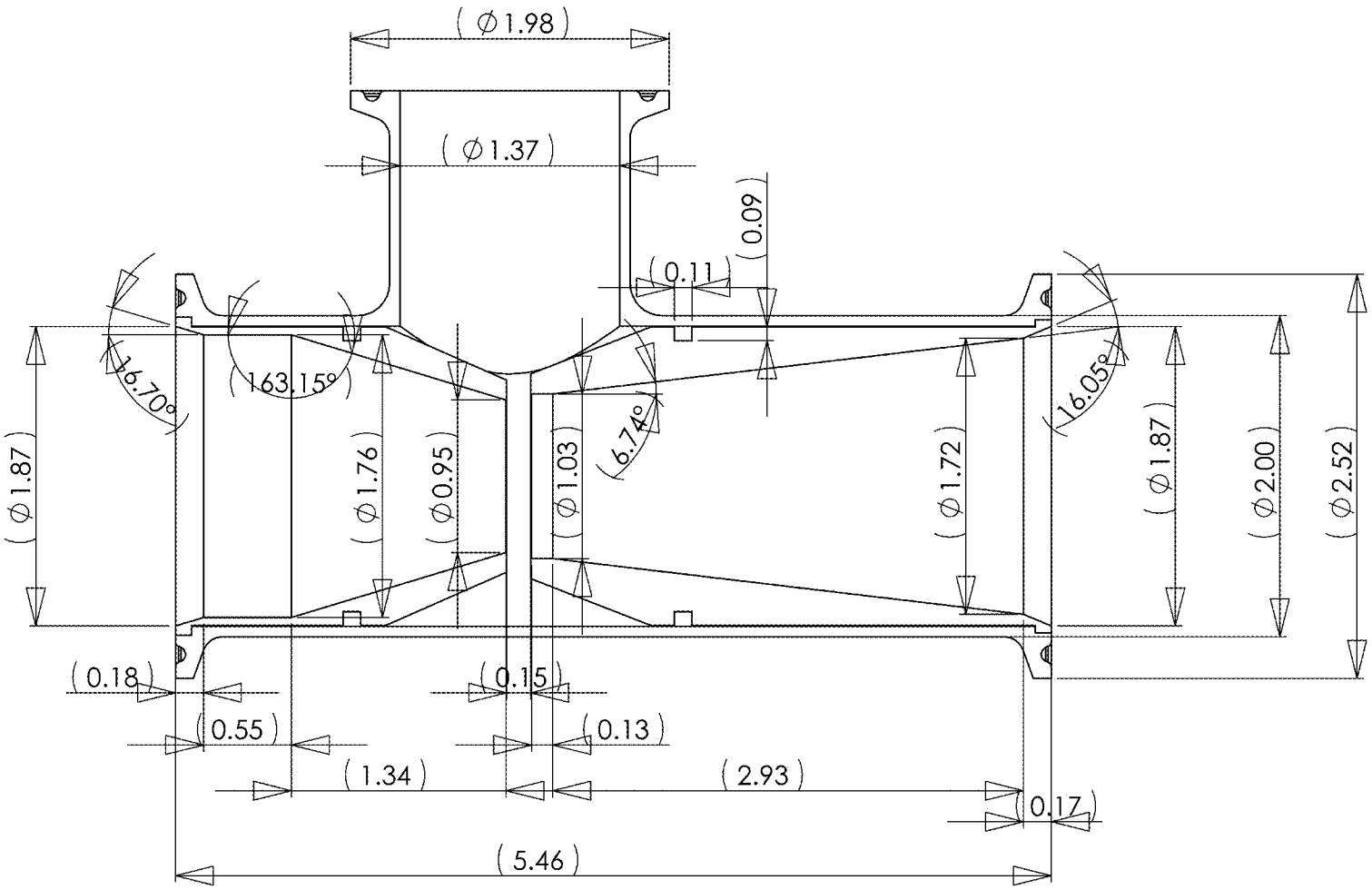
FIG. 15 is a cross-sectional view of the assembled converging and diverging cones 120, 130 of FIG. 11 along the X-Z plane.
Figure 16:
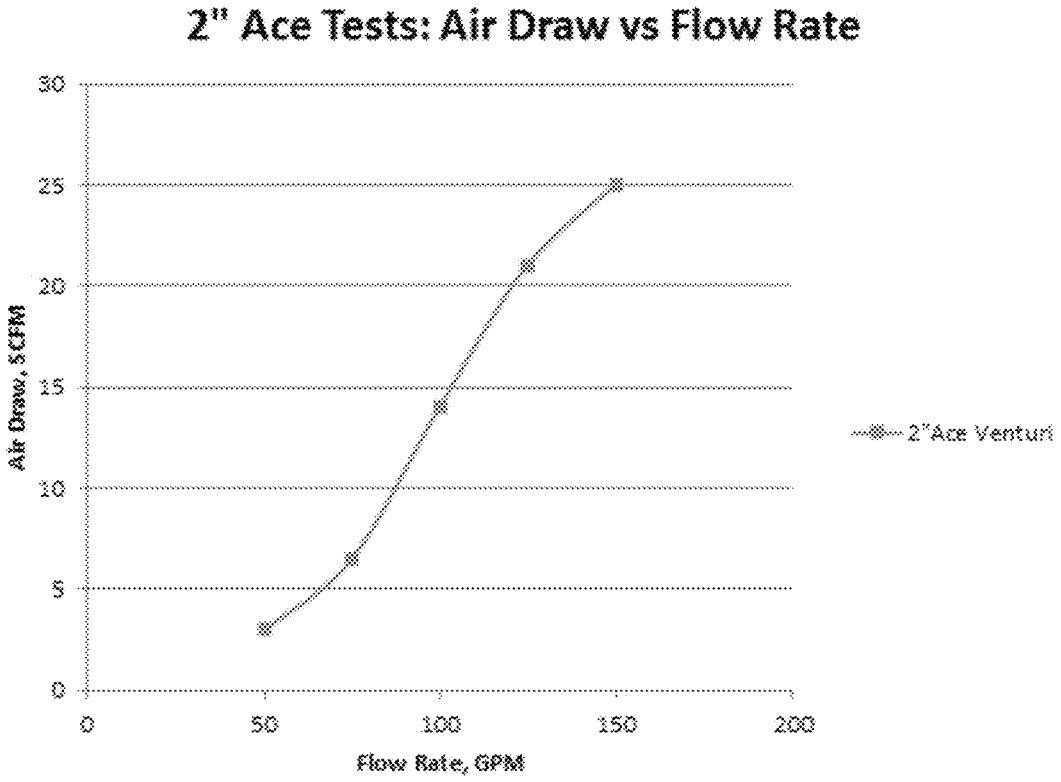
FIG. 16 depicts the air draw versus flow rate plot for a Venturi device of FIG. 11 having a diameter of 2 inches.
Figure 17:
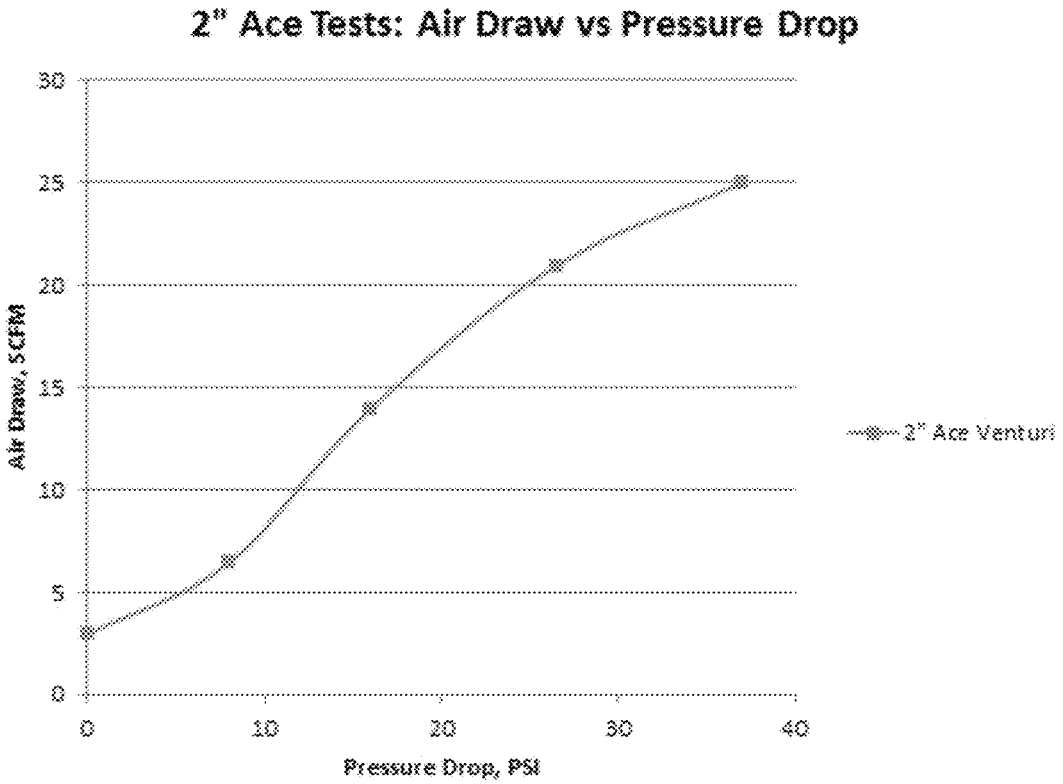
FIG. 17 depicts the air draw versus pressure drop plot for a Venturi device of FIG. 11 having a diameter of 2 inches.
Figure 18:
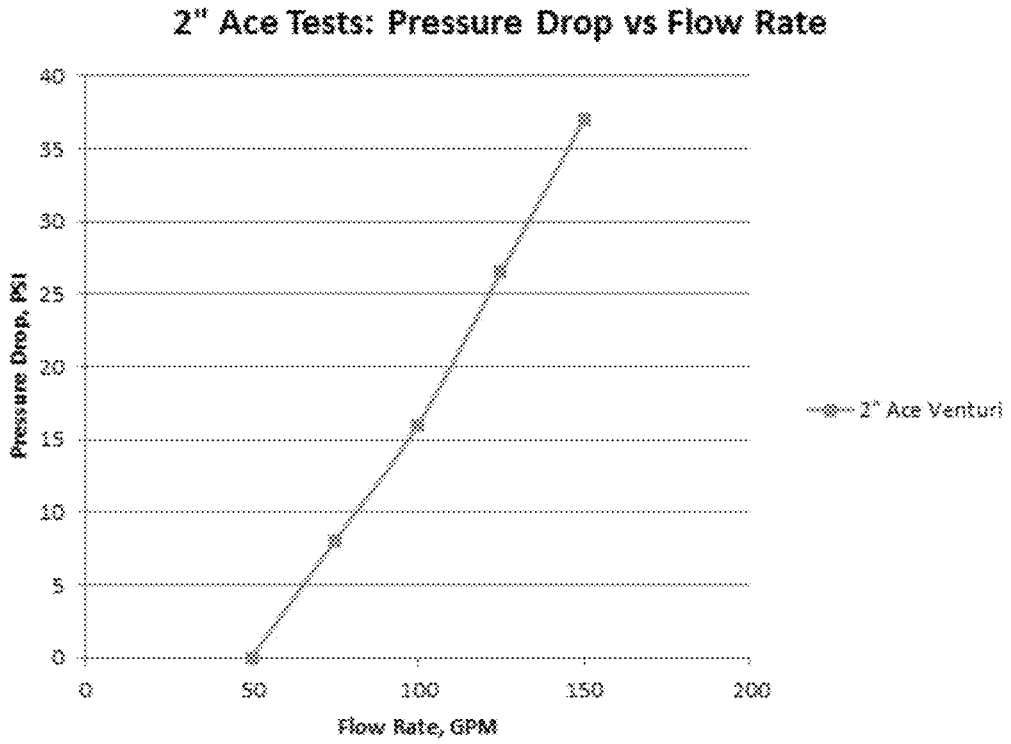
FIG. 18 depicts the pressure drop versus flow rate plot for a Venturi device of FIG. 11 having a diameter of 2 inches.
Figure 19:
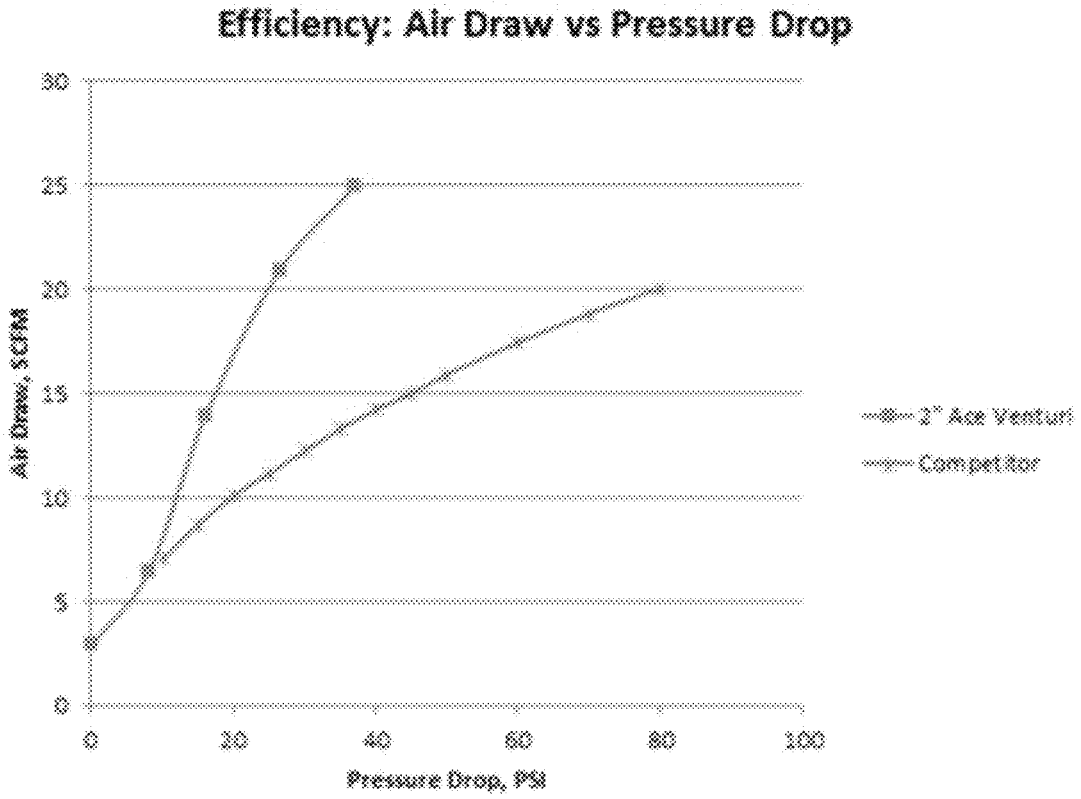
FIG. 19 depicts the air draw versus pressure drop plot for a Venturi device of FIG. 11 having a diameter of 2 inches and for a prior art Venturi product.

As was mentioned above, the dimensions of the converging and diverging cones 120, 130 are optimized to provide a large volume of second fluid 2 with as low of a pressure drop as possible. In one example, the assembled Venturi 100 has a total length of 5.46 inches and a diameter of 2 inches. The converging cone 120 has a length of 2.07 inches, an inlet diameter of 1.87 inches, an outlet diameter of 0.95 inch and a conical angle of 16.85 degrees relative to the X-axis, as shown in FIG. 15. In other examples, the conical angle of the converging cone is in the range of 5 to 8 degrees. The corresponding diverging cone 130 has a length of 3.23 inches, an inlet diameter of 1.03 inches, an outlet diameter of 1.72 inches and a conical angle of 6.74 degrees relative to the X-axis, as shown in FIG. 15. In other examples, the conical angle of the diverging cone is in the range of 15 to 25 degrees. In this example, the gap 125 between the outlet of the converging cone 120 and the diverging cone 130 is 0.15 inch. In other examples, gap 125 is in the range of 0.05 to 0.2 inches. The performance of this 2-inch Venturi is shown in FIG. 16 to FIG. 19. FIG. 16 depicts the air draw versus flow rate plot for the 2-inch Venturi device. FIG. 17 depicts the air draw versus pressure drop plot for the 2-inch Venturi device. FIG. 18 depicts the pressure drop versus flow rate plot for the 2-inch Venturi device. FIG. 19 depicts the air draw versus pressure drop plot for the 2-inch Venturi device and for a competitive Venturi product.

Several embodiments of the present invention have been described. Nevertheless, it will be understood that various modifications may be made without departing from the spirit and scope of the invention. Accordingly, other embodiments are within the scope of the following claims.

What is claimed is:

1. A Venturi device for introducing a second fluid into a first fluid comprising:

a T-joint component comprising a first elongated tube extending along a first direction and a second elongated tube extending along a second direction being perpendicular to the first direction, wherein said first elongated tube comprises a first inlet port and an outlet port and a first through-opening extending from the first inlet port to the outlet port along the first direction and wherein said second elongated tube is integral with the first elongated tube and comprises a second inlet port and a second through-opening communicating with the first through-opening and extending along the second direction from the second inlet port to an inner section of the first through-opening;

a converging component shaped and dimensioned to slip fit within the first through-opening of the first elongated tube through the first inlet port and comprising a cross-section that decreases along the first direction from the first inlet port to the inner section of the first through-opening;

a diverging component shaped and dimensioned to slip fit within the first through-opening of the first elongated tube through the outlet port and comprising a cross-section that increases along the first direction from the inner section of the first through-opening to the outlet port;

wherein the converging component is coaxially aligned with the diverging component along the first direction;

wherein the converging component comprises a converging angle of 16.85 degrees relative to the first direction and the diverging component comprises a diverging angle of 6.74 degrees relative to the first direction;

wherein the first fluid enters the converging component through the first inlet port and flows toward the inner section of the first through-opening and the second fluid is drawn into the inner section of the first through-opening from the second inlet port through the second through-opening and wherein the second fluid mixes with the first fluid in the inner section of the first through-opening thereby forming a mixed fluid and the mixed fluid flows through the diverging component and exits through the outlet port.

2. The device of claim 1, wherein a gap is formed between adjacent inner ends of the converging component and the diverging component, respectively, and wherein the gap comprises a circle that is coaxial with the first direction and is located within the inner section of the first through-opening and wherein the second fluid mixes with the first fluid within the gap.

3. The device of claim 2, wherein the converging component position and the diverging component position within the T-joint component are secured and the gap remains unchanged during operation.

4. The device of claim 1, wherein first and second shoulders are formed around an outer end of the converging component and an outer end of the diverging component, and the first and second shoulders are recessed into the inlet port and outlet port of the T-joint, respectively, thereby securing the converging component position and the diverging component position within the T-joint and relative to each other.

5. The device of claim 1, wherein the converging component comprises an elongated body having a cylindrical section at an outer end, a converging frusto-conical inner section at an inner end and an axial through-opening extending from the outer end to the inner end along the first direction.

6. The device of claim 5, wherein the converging component comprises fins located on an outer surface of the converging frusto-conical section.

7. The device of claim 1, wherein the diverging component comprises an elongated body having a cylindrical inner section at an inner end, a diverging frusto-conical inner section at an outer end and an axial through-opening extending from the inner end to an outer end along the first direction.

8. The device of claim 7, wherein the diverging component comprises fins located on an outer surface of the diverging frusto-conical section.

9. The device of claim 1, further comprising first and second O-rings surrounding the converging component and the diverging component, respectively.

10. The device of claim 1, wherein the converging component comprises teeth extending from an inner end of the converging component along the first direction and wherein the teeth couple with an inner end of the diverging component.

11. The device of claim 1, further comprising first and second gaskets integral with an outer end of the converging component and an outer end of the diverging component, respectively.

12. The device of claim 11, wherein the first and second gaskets comprise a triangular cross-section.

13. The device of claim 1, wherein the T-joint component comprises one of stainless steel, cast steel, non-corrosive metal, ceramic, composite or polymer material.

14. The device of claim 1, wherein the converging component and the diverging component comprise one of polymer materials, stainless steel, metal alloys, non-corrosive metals, ceramics, or composites.

15. The device of claim 1, wherein the first fluid comprises one of wine, tea, cider, coffee, probiotic liquid, water, or gasoline.

16. The device of claim 1, wherein the second fluid comprises one of air, oxygen, gas, food additives, or liquid.

17. A method for introducing a second fluid into a first fluid comprising:

providing a Venturi device comprising a T-joint component, a converging component and a diverging component, wherein the T-joint component comprises a first elongated tube extending along a first direction and a second elongated tube extending along a second direction being perpendicular to the first direction, wherein said first elongated tube comprises a first inlet port and an outlet port and a first through-opening extending from the first inlet port to the outlet port along the first direction and wherein said second elongated tube is integral with the first elongated tube and comprises a second inlet port and a second through-opening communicating with the first through-opening and extending along the second direction from the second inlet port to an inner section of the first through-opening; wherein the converging component is shaped and dimensioned to slip fit within the first through-opening of the first elongated tube through the first inlet port and comprises a cross-section that decreases along the first direction from the first inlet port to the inner section of the first through-opening; wherein the diverging component is shaped and dimensioned to slip fit within the first through-opening of the first elongated tube through the outlet port and comprises a cross-section that increases along the first direction from the inner section of the first through-opening to the outlet port; wherein the converging component comprises a converging angle of 17.43 degrees relative to the first direction and the diverging component comprises a diverging angle of 6.44 degrees relative to the first direction; and wherein the converging component is coaxially aligned with the diverging component along the first direction;

introducing the first fluid into the converging component through the first inlet port and flowing the first fluid toward the inner section of the first through-opening;

drawing the second fluid into the inner section of the first through-opening from the second inlet port through the second through-opening;

mixing the second fluid with the first fluid in the inner section of the first through-opening thereby forming a mixed fluid, wherein a gap is formed between adjacent inner ends of the converging component and the diverging component, respectively, and wherein the gap comprises a circle that is coaxial with the first direction and is located within the inner section of the first through-opening and wherein the second fluid mixes with the first fluid within the gap; and flowing the mixed fluid through the diverging component and exiting the mixed fluid through the outlet port.

18. The method of claim 17, wherein the first fluid comprises one of wine, tea, cider, coffee, probiotic liquid, water, or gasoline.

19. The method of claim 17, wherein the second fluid comprises one of air, oxygen, gas, food additives, or liquid.

20. A Venturi device for introducing a second fluid into a first fluid comprising:

a T-joint component comprising a first elongated tube extending along a first direction and a second elongated tube extending along a second direction being perpendicular to the first direction, wherein said first elongated tube comprises a first inlet port and an outlet port and a first through-opening extending from the first inlet port to the outlet port along the first direction and wherein said second elongated tube is integral with the first elongated tube and comprises a second inlet port and a second through-opening communicating with the first through-opening and extending along the second direction from the second inlet port to an inner section of the first through-opening;

a converging component shaped and dimensioned to slip fit within the first through-opening of the first elongated tube through the first inlet port and comprising a cross-section that decreases along the first direction from the first inlet port to the inner section of the first through-opening;

a diverging component shaped and dimensioned to slip fit within the first through-opening of the first elongated tube through the outlet port and comprising a cross-section that increases along the first direction from the inner section of the first through-opening to the outlet port;

wherein the converging component is coaxially aligned with the diverging component along the first direction;

wherein the converging component comprises a converging angle of 17.43 degrees relative to the first direction and the diverging component comprises a diverging angle of 6.44 degrees relative to the first direction.

* * * * *